US007254870B2

(12) United States Patent
Kageyama et al.

(10) Patent No.: US 7,254,870 B2
(45) Date of Patent: Aug. 14, 2007

(54) CLIP FIXING STRUCTURE

(75) Inventors: Hidehei Kageyama, Kawagoe (JP); Tadao Odaka, Kawagoe (JP)

(73) Assignee: Kotobuki & Co., Ltd., Kawagoe-shi, Saitama-ken (JP)

( * ) Notice: Subject to any disclaimer, the term of this patent is extended or adjusted under 35 U.S.C. 154(b) by 9 days.

(21) Appl. No.: 11/226,420

(22) Filed: Sep. 15, 2005

(65) Prior Publication Data

US 2006/0053595 A1 Mar. 16, 2006

(30) Foreign Application Priority Data

Sep. 16, 2004 (JP) ..... 2004-269362

(51) Int. Cl.
*B43K 25/00* (2006.01)
*B43K 25/02* (2006.01)

(52) U.S. Cl. ..... 24/11 R; 401/104; 24/11 HC

(58) Field of Classification Search ..... 401/104
See application file for complete search history.

(56) References Cited

U.S. PATENT DOCUMENTS 2,418,218 A * 4/1947 Bauer et al. ..... 24/11 R
2,473,689 A * 6/1949 Colstad ..... 24/11 R
2,537,793 A * 1/1951 Seibert ..... 24/11 R
2,837,801 A * 6/1958 Seibert et al. ..... 24/11 R
3,092,080 A * 6/1963 Lovejoy ..... 401/104
6,308,380 B1 * 10/2001 Cheng ..... 24/11 HC

FOREIGN PATENT DOCUMENTS

JP 04-288297 10/1992
JP 5-2993 1/1993

* cited by examiner

*Primary Examiner*—Robert J. Sandy
(74) *Attorney, Agent, or Firm*—McGinn IP Law Group PLLC

(57) ABSTRACT

A cap fixing structure is provided, which is excellent in operability and can be easily assembled. An outer shaft barrel to be fixed with a clip is formed on the outer peripheral surface with an opening, and inside the outer shaft barrel, there is fixedly disposed a clip spring having an elastically displaceable elastic piece portion. The clip comprises a clip main body disposed outside of an outer shaft barrel, and a base portion to enter into the outer shaft barrel from the opening formed in the outer shaft barrel. The base portion of the clip is stopped from being fell out of the opening by the clip spring with elastically contacting the elastic piece portion of the clip spring inside said fixed member so that the clip is fixed to the fixing member. The clip displaces the elastic piece portion so as to be rockable relative to the outer shaft barrel.

20 Claims, 16 Drawing Sheets

CLIP FIXING STRUCTURE

BACKGROUND OF THE INVENTION

1. Field of the Invention

The present invention relates to a clip fixing structure in which a clip is fixed to a fixed member such as a writing tool, a toilet tool, and the like.

2. Description of the Related Art

Heretofore, the clip fixing structure, for example, disclosed in Japanese Utility Mode Laid-Open No. 5-2993 or Japanese Patent Laid-Open No. 4-288297 has been known.

The clip fixing structure disclosed in Japanese Utility Mode Laid-Open No. 5-2993 comprises a metallic resilient clip formed at its back side with an inserting portion having a dimension equal to an inside dimension of a fixing hole formed in a fixed barrel such as a shaft barrel, a cap and the like, and also formed with a tongue whose tip end portion Is curved in a center direction of the fixed barrel so as to be provided adjacent to the inserting portion. The top end portion of the clip back side and a ball at the clip back side are pressed toward the surface of the fixed barrel, so that the tongue is pressed toward the inner surface of the fixed barrel on the tip end side from the fixing hole. When assembling, the tip end edge of the tongue does not hit upon the end edge of the fixing hole so that it can be easily attached.

The clip fixing structure disclosed in Japanese Patent Laid-Open No. 4-288297 is constructed by that the clip attached to an inner cap. The inner cap has a guide portion, and the clip is displaceably disposed along the guide portion by opposing the spring force of a clip spring, and the inner cap is surrounded by an outer cap. In this manner, the clip can displace in a direction to obliquely break away from the inner cap by opposing the spring force of the clip spring. Further, when the clip force is released, the clip can return to the original position by the spring force of the clip spring.

However, according to the clip fixing structure disclosed in Japanese Utility Mode Laid-Open No. 5-2993, since the clip provides a spring property only by elasticity possessed by the clip itself, when the clip is rocked against the main body to grip a thing by the clip, a considerable force is required, and a problem is that It is difficult to rock the clip to a large extent.

According to the clip fixing structure disclosed in Japanese Patent Laid-Open No. 4-288297, since the elastic force of the clip is provided by the clip spring, the operability is presumed to be better than Japanese Utility Mode Laid-Open No. 5-2993, and yet its structure is complicated, and a problem is that the number of component parts is increased, and assembling work is not easy.

The present invention has been made in view of the above described problems, and an object of the invention is to provide a cap fixing structure which is excellent in operability and is easy to assemble.

SUMMARY OF THE INVENTION

To achieve the object, the clip fixing structure according to the present invention to fix a rockable clip to a fixed member is characterized in that an outer peripheral surface of the fixed member is formed with an opening, and a clip spring having an elastic piece portion elastically displaceable is fixedly disposed inside the fixed member, and the clip comprises a clip main body disposed outside of the fixed member and a base portion entering into the fixed member from its opening, and the base portion of said clip is stopped from being fell out of the opening by the clip spring with elastically contacting the elastic piece portion of the clip spring inside said fixed member so that the clip is fixed to the fixing member, and the clip is rockable relative to the fixed member by displacing the elastic piece portion of the clip spring.

According to the present invention, when the clip is inserted into the fixed member, the clip is stopped from being fell out of the opening by the clip spring. This can ensure the clip to be fixed to the fixed member. Since the clip is stopped from being fell out of the opening by the clip spring, the clip can be fixed with the small number of component parts, and the assembly work thereof can be also made simple. Further, since the clip elastically contacts the elastic piece portion of the clip spring, the clip can be rocked by utilizing its elasticity. Even if the clip itself is not given high spring properties, the clip can be simply rocked with excellent spring properties.

The base portion of the clip can be gripped by the clip spring whereby the base portion is stopped from being fell out of the opening. Since the stopping of falling out is performed only by gripping the base portion of the clip by the clip spring, the clip can be simply fixed to the fixed member.

The base portion of the clip can have an engaging portion to engage with one portion of the clip spring and a stopper portion to abut against an end surface portion of the elastic piece portion, and the base portion of the clip, during assembling, enters into the fixed member while pressing the elastic piece portion, and when moving so as to engage with the one portion of the clip spring, the stopper portion abuts against the end surface portion of the elastic piece portion.

During assembly, when the base portion of the clip enters into the fixed member while pressing the elastic piece portion, and further, when the clip moves and the stopper portion of the base portion of the clip abuts against the end edge portion of the elastic piece portion, the clip is unable to move in a reverse direction. This does not allow the engagement with the clip spring of the base portion of the clip to be released, and therefore, the clip can be simply fixed, and at the same time, once it is fixed, it is not possible to be simply removed.

The base portion of the clip can configure a loop portion solely or together with other members inside the fixed member, and is stopped from being fell out of the opening by that the elastic piece portion is inserted into the loop portion. Since the base portion is stopped from being fell out of the opening by that the elastic piece portion is inserted into the loop portion configured by the base portion of the clip, the clip can be simply fixed to the fixed member.

The tip end of the elastic piece portion can be folded back, and the folded portions are inserted into the loop. When the clip is rocked, though the fold ed portion of the elastic piece portion is displaced, since it is the folded portion, it is high in elasticity and rigidity, and for this reason, it can be given durability of the clip spring and high restoring force of the clip.

DETAILED DESCRIPTION OF THE PREFERRED EMBODIMENTS

Embodiments of the present invention will be described below with reference to the drawings.

First Embodiment

Figure 1A:
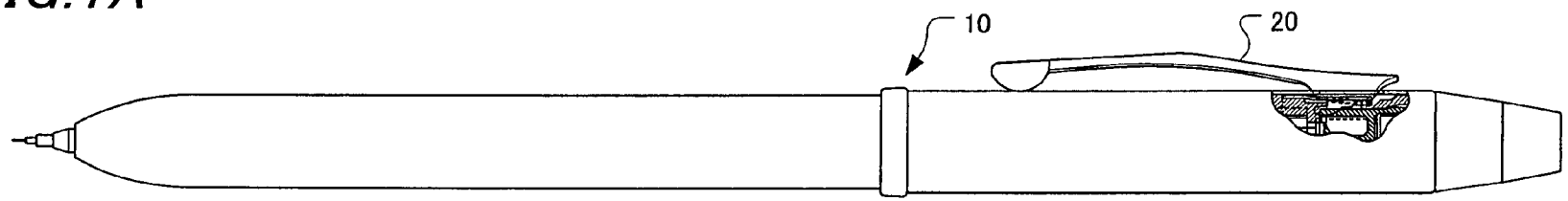
FIG. 1A is a whole view of a writing tool adapted to the clip structure according to a first embodiment of the present Invention.

FIG. 1 is the whole view of a writing tool adapted to the clip structure according to a first embodiment of the present invention. In the Figure, reference numeral 10 denotes a product fixed with a clip, which is a writing tool in this example, but can be a toilet tool or other arbitrary products. The product 10, to be more in detail, comprises an outer shaft barrel 12 as a fixed member, an inner shaft barrel 14, a tall tap 16, and moreover, a functional unit including the inner shaft barrel 14 or configured separately from the inner shaft barrel 14. The functional unit is a part or a mechanism required to perform a primary function of the product 10, and for example, corresponds to a mechanism to propel a writing body or an applicator or to a portion to protect the tip end of the writing tool or the like, but since it is out of the content of the present invention, the detailed description thereof will be omitted, though it can be an arbitrary part or mechanism.

Figure 2B:
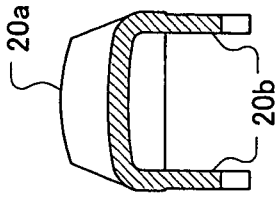
FIG. 2B is a sectional view taken along the line 2B to 2B of FIG. 2A.
Figure 2A:
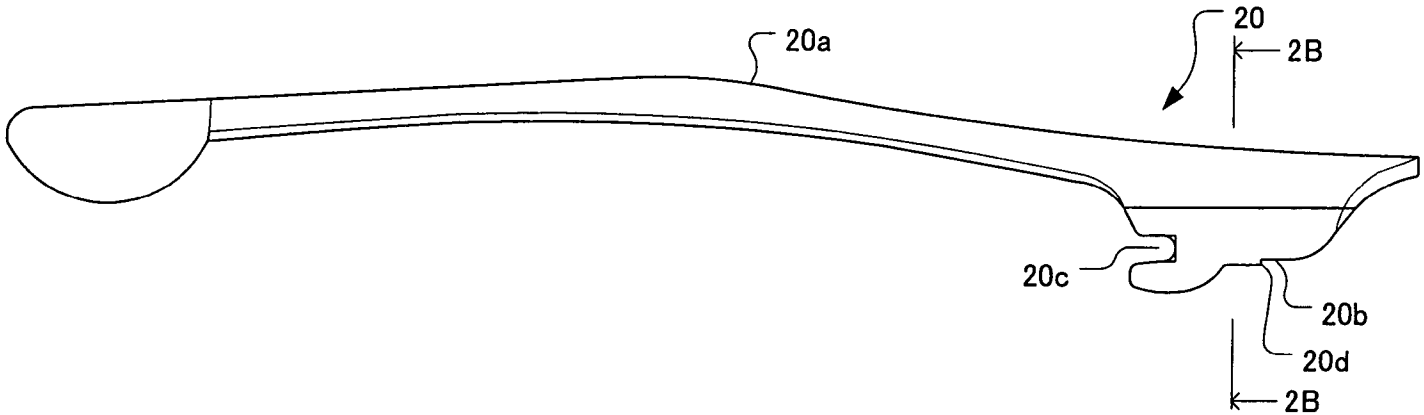
FIG. 2A is a side view of a clip of the first embodiment.

A clip 20 to be fixed to the outer shaft barrel 12, as shown in FIG. 2, comprises a clip main body 20*a* which extends along the outer periphery of the outer shaft barrel 12 and has a transverse sectional shape of an inverted U shape in its entirety and a pair of base portions 20*b* which enters into the outer shaft barrel 12. Between the tip end of the clip main body 20*a* and the outer shaft barrel 12, a document, clothing, and the like can be nipped. Each of the base portions 20*b* extends from the rear end of the clip main body 20*a* to the outer shaft barrel 12, and is formed with a notch 20*c* facing ahead of the base portion, and further, is formed with a small stopper step portion 20*d* facing rearward so as to oppose to the notch 20*c*. The notch 20*c* functions as an engagement portion, which will be described later.

Figure 5A:
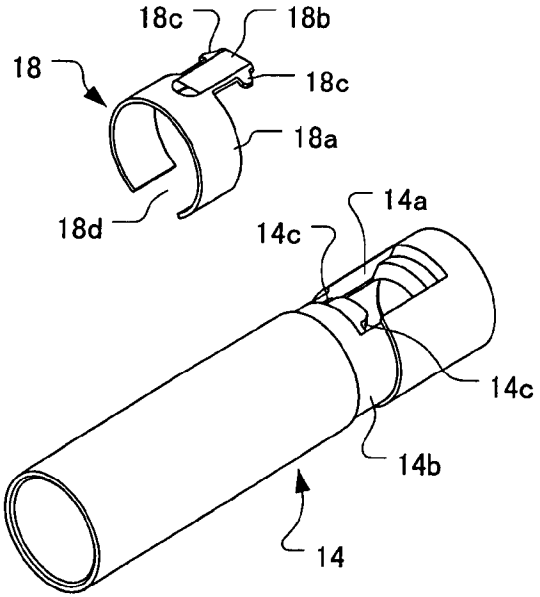
FIG. 5A is a view showing an assembly procedure of a clip fixing structure of the first embodiment.
Figure 5C:
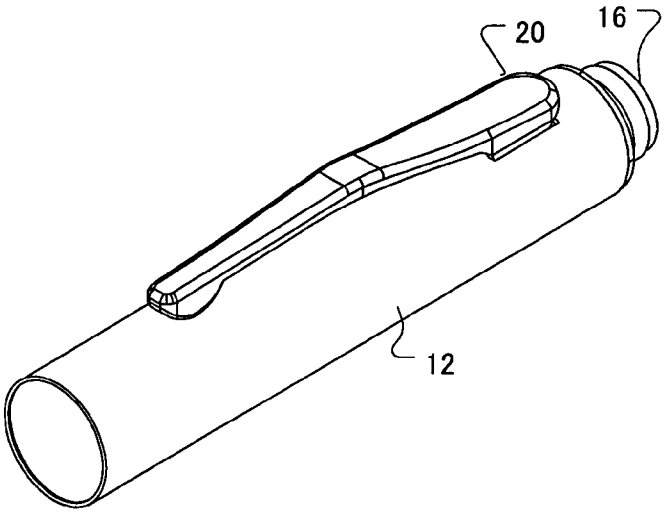
FIG. 5C is a view showing an assembly procedure of a clip fixing structure of the first embodiment.
Figure 5B:
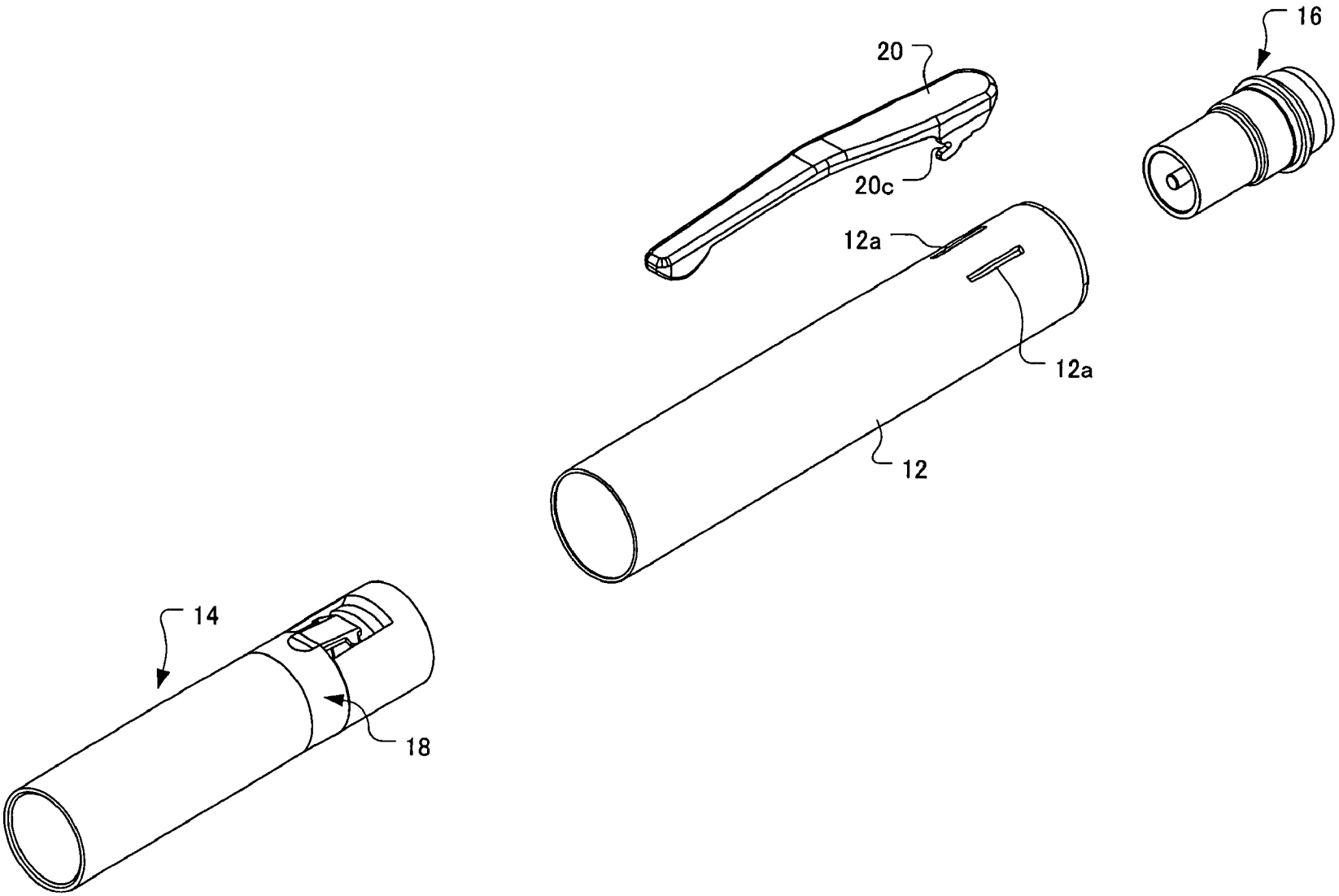
FIG. 5B is a view showing an assembly procedure of a clip fixing structure of the first embodiment.

The outer shaft barrel 12 is formed on its peripheral surface with a pair of slit openings 12*a* and 12*a* to be inserted by the base portions 20*b* of the clip 20 (see FIG. 5B).

Figure 3A:
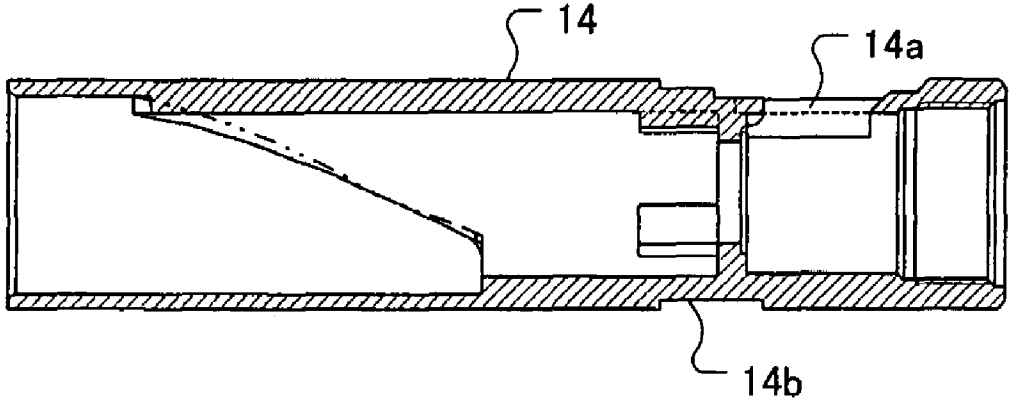
FIG. 3A is a longitudinal sectional view of an inner shaft barrel of the first embodiment.
Figure 3B:
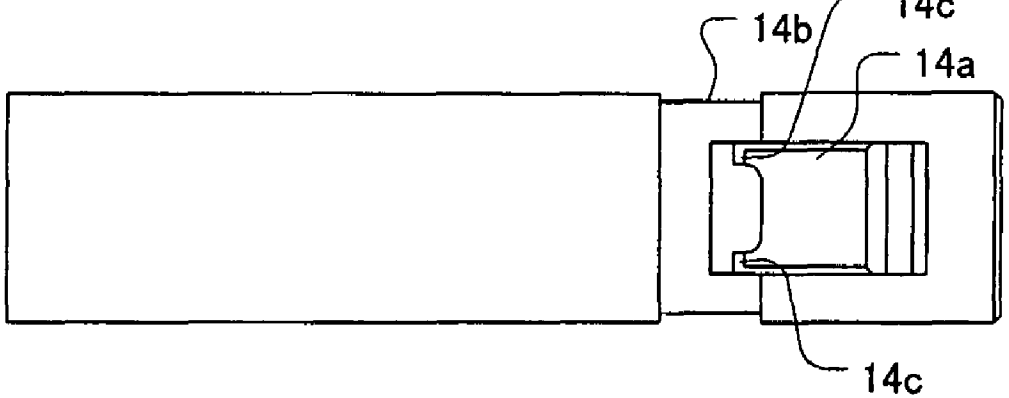
FIG. 3B is a plan view of the inner shaft barrel of the first embodiment.

The inner shaft barrel 14, as shown in FIGS. 3A and 3B, is formed on its peripheral surface with an opening 14*a*, and adjacent to the opening 14*a*, there is formed a circular groove 14*b*. In the front end of the opening 14*a*, there is formed a pair of notches 14*c* continued from the opening 14*a*.

Figure 4B:
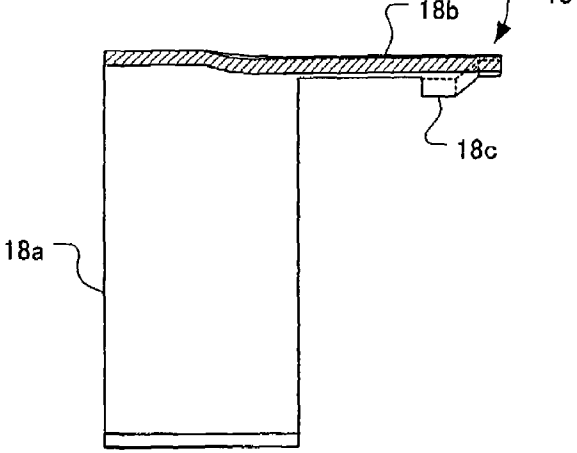
FIG. 4B is a longitudinal sectional view of the clip spring of the first embodiment.
Figure 4D:
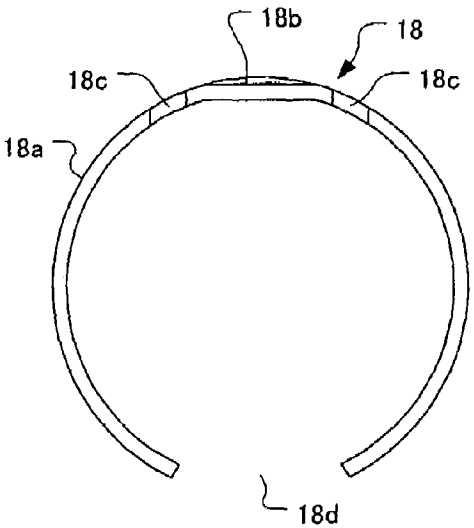
FIG. 4D is a rear view of the clip spring of the first embodiment.
Figure 4A:
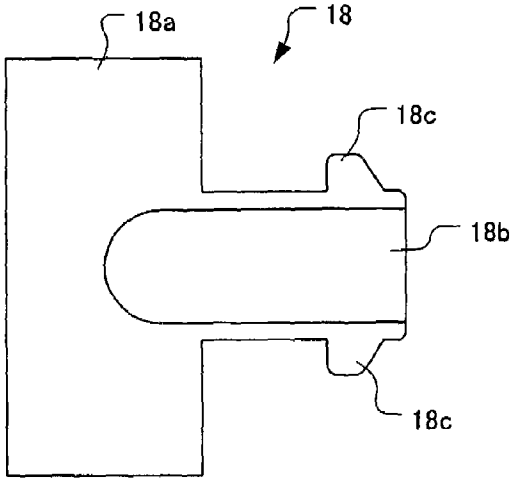
FIG. 4A is a plan view of a clip spring of the first embodiment.
Figure 4C:
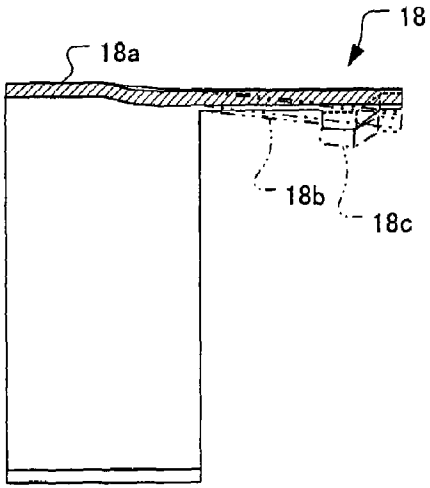
FIG. 4C is a longitudinal sectional view of the clip spring of the first embodiment.

A circular groove 14*b* of the inner shaft barrel 14 is fitted and fixed with a clip spring 18 The clip spring 18, as shown in FIGS. 4A to 4D, has a ring portion 18*a* fitted to the circular groove 14*b* and an elastic piece portion 18*b* extending rearward from one region of the ring portion 18*a*. The ring portion 18*a* is formed with a slit 18*d*. Further, the elastic piece portion 18*b* is formed at the rear with a receiving portion 18*c* protruding from both side faces in a circumferential direction. The elastic piece portion 18*b*, as shown in FIG. 4C, can be elastically displaced in a radial direction.

The rear inside of the inner shaft barrel 14 is screwed with the tail tap 16. The tail tap 16 and the inner shaft barrel 14 are connected with each other crossing the rear end surface of the outer shaft barrel 12 so that they are attached to the outer shaft barrel 12.

The clip fixing procedure of the clip fixing structure configured by the above described component parts will be described with reference to FIGS. 5 and 6.

First, the circular groove 14*b* of the inner shaft barrel 14 is fitted with the ring portion 18*a* of the clip spring 18 (FIG. 5A). At this time, the slit 18*d* can be properly expanded and fitted.

Next, the assembly of the inner shaft barrel 14 and clip spring 18 is inserted into the outer shaft barrel 12 from the front of the outer shaft barrel 12. Further, the tail tap 16 is inserted from the rear side of the outer shaft barrel 12 and is screwed into the inner shaft barrel 14. At this time, the slit openings 12*a* and 12*a* of the outer shaft barrel 12 and the opening 14*a* of the inner shaft barrel 14 are disposed in position to be aligned with. In this state, each base portion 20*b* of the clip 20 is inserted into the corresponding slit opening 12*a* of the outer shaft barrel 12. The base portion 20*b* enters into a space formed between the receiving portion 18*c* and the ring portion 18*a* at both sides of the elastic piece portion 18*b* of the clip spring 18 inside the outer shaft barrel 12 and in the opening 14*a* inside the inner shaft barrel 14.

Figure 6A:
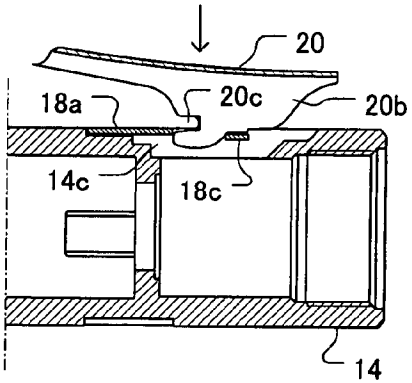
FIG. 6A is an enlarged sectional view at the assembly time of the clip fixing structure of the first embodiment.
Figure 6B:
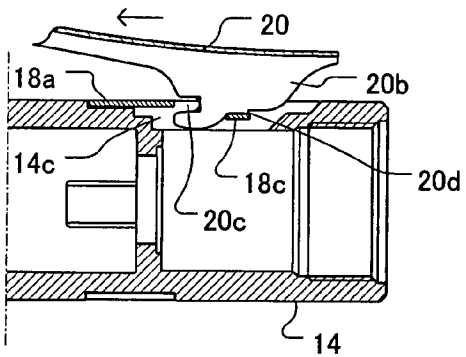
FIG. 6B is an enlarged sectional view at the assembly time of the clip fixing structure of the first embodiment.
Figure 6C:
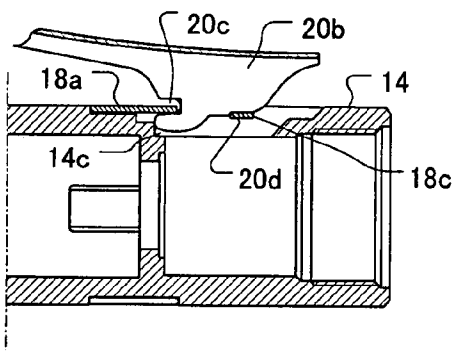
FIG. 6C is an enlarged sectional view at the assembly time of the clip fixing structure of the first embodiment.

FIGS. 6A to 6C are sectional views inside the outer shaft barrel 12, which omit the outer shaft barrel 12 for convenience of explanation. Accompanied with entering into the outer shaft barrel 12 of the base portion 20*b*, the base portion 20*b* abuts against the receiving portion 18*c* from the upper side, and presses down the receiving portion 18*c* (FIG. 6A). When the base portion 20*b* is further pressed and after the notch 20*c* is almost inserted into the outer shaft barrel 12, the clip 20 is moved leftward in FIG. 63. Then, the ring portion 18*a* of the clip spring 18 and the unillustrated outer shaft barrel 12 enter relatively into the notch 20*c*. Note that, at the same time, a portion lower than the notch 20*c* of the base portion 20*b* enters into the notch 14*c* of the opening 14*a*.

Further, at the same time, since the stopper step portion 20*d* passes through above the receiving portion 18*c*, the receiving portion 18*c* is slightly returned upward by the elastic force of the elastic piece portion 18*b*, and the stopper step portion 20*d* abuts against the end portion of the receiving portion 18*c*, and both of them are engaged.

In the above described manner, by the simple assembly procedure, the clip 20 can be fixed to the fixed member 10. The clip 20, in a fixed state, has the notch 20*c* engaged with the ring portion 18*a* of the clip spring 18 and the outer shaft barrel 12. Moreover, the stopper step portion 20*d* is engaged with the receiving portion 18*c* of the clip spring 18. Even if an attempt is made to return the clip 20 rearward in order to release the engagement among the notch 20*c*, the clip spring 18, and the outer shaft barrel 12, because of the engagement between the stopper step portion 20*d* and the receiving portion 18*c*, the clip 20 is unable to retreat. In other words, the base portion 20*b* of the clip 20 is sandwiched between the ring portion 18*a* of the clip spring 18 and the receiving portion 18*c*. Hence, once the clip 20 Is fixed, it is not allowed to be simply removed. Further, the base portion 20*b* of the clip 20 elastically contacts the receiving portion 18*c* of the elastic piece portion 18*b*.

Figure 1B:
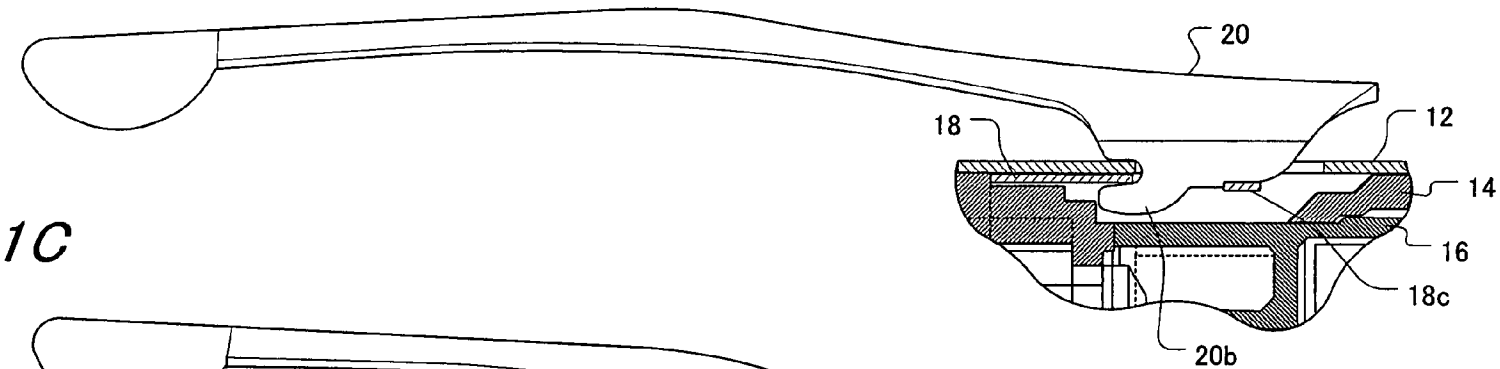
FIG. 1B is a partially sectional enlarged view of FIG. 1A.
Figure 1C:
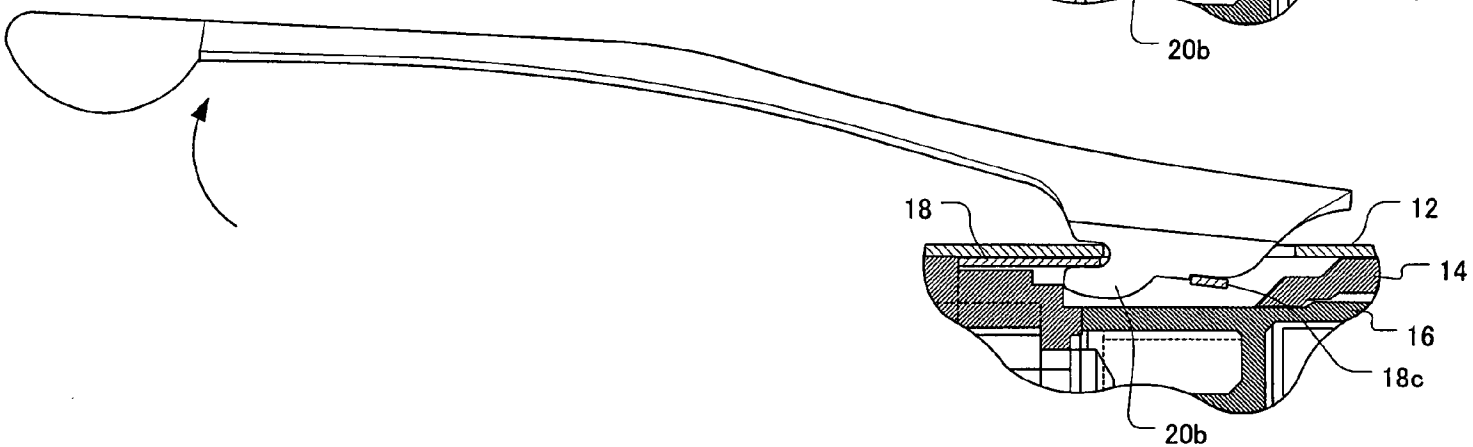
FIG. 1C is a partially sectional enlarged view of FIG. 1A, and shows a state in which the clip is rocked.

When the clip 20 fixed in this manner, as shown in FIGS. 1B and 1C, is rocked so as to nip a thing between the clip 20 and the outer shaft barrel 12, the clip 20 rotates around the notch 20*c* as a fulcrum point, and at this time, since the base portion 20*b* presses the receiving portion 18*c* and pushes the elastic piece portion lab into the external shaft barrel 12, the elastic piece portion 18*b* is deformed. Further, when the force applied to the clip 20 is released, the elastic piece portion 18*b* is restored to its original state by restoring force of the elastic piece portion 18*b*.

In this manner, by utilizing the spring force of the elastic piece portion lab of the clip spring 18, the clip 20 can be rocked, and therefore, the elastic force of the clip 20 itself is not needed to use mainly, thereby providing an excellent operability.

Second Embodiment

Figure 7A:
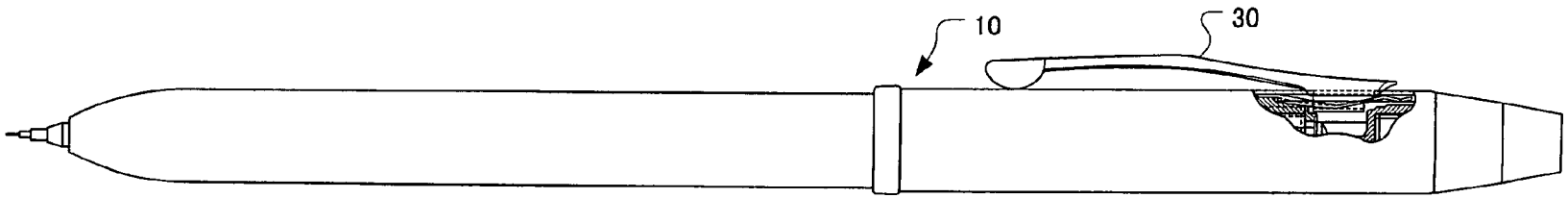
FIG. 7A is a whole view of the writing tool adapted to the clip structure according to a second embodiment of the present invention.

FIG. 7 is a whole view of a writing tool adapted to the clip structure according to a second embodiment of the present invention. The same component parts as the first embodiment are attached with the same reference numerals, and therefore, the description thereof will be omitted.

In the Figure, reference numeral 10 denotes a product fixed with a clip, and the product 10, to be more in detail, comprises an outer shaft barrel 22 as a fixed member, an inner shaft barrel 24, a tail tap 26, and moreover, a functional unit including the inner shaft barrel 24 or configured separately from the inner shaft barrel 24.

Figure 8B:
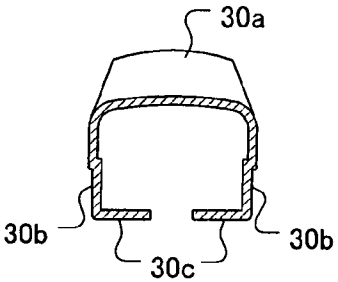
FIG. 8B is a sectional view taken along the line 8B to 8B of FIG. 8A.
Figure 8A:
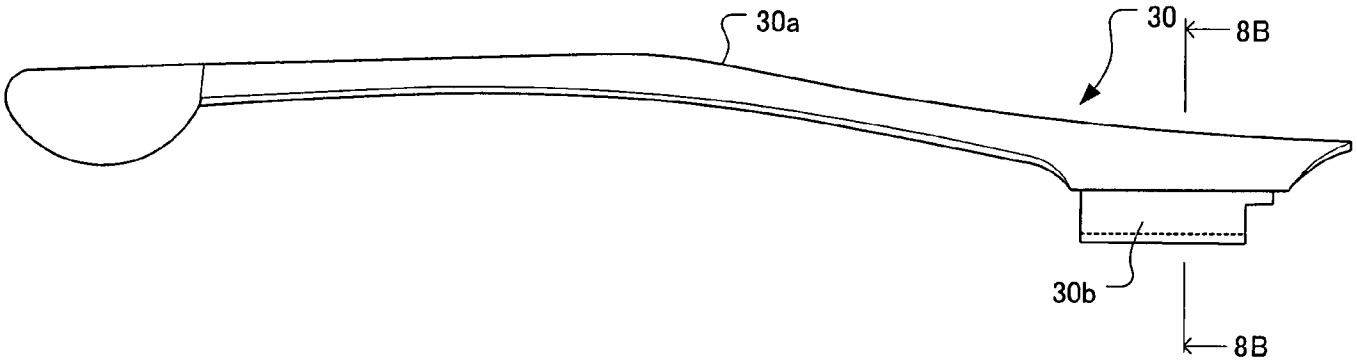
FIG. 8A is a side view of the clip of the second embodiment.

A clip 30 to be fixed to the outer shaft barrel 22, as shown in FIG. 8, comprises a clip main body 30*a* which extends along the outer periphery of the outer shaft barrel 22 and has a transverse sectional shape of an inverted U shape in its entirety and a pair of base portions 30*b* which enter into the outer shaft barrel 22. Between the tip end of the clip main body 30*a* and the outer shaft barrel 22, a document clothing, and the like can be nipped. A pair of base portions 30*b* extend from the rear end of the clip main body portion 30*a* to the outer shaft barrel 22, and the tip end thereof has bent portions 30*c* bent almost vertical so as to close with each other.

Figures 11A, 11C:
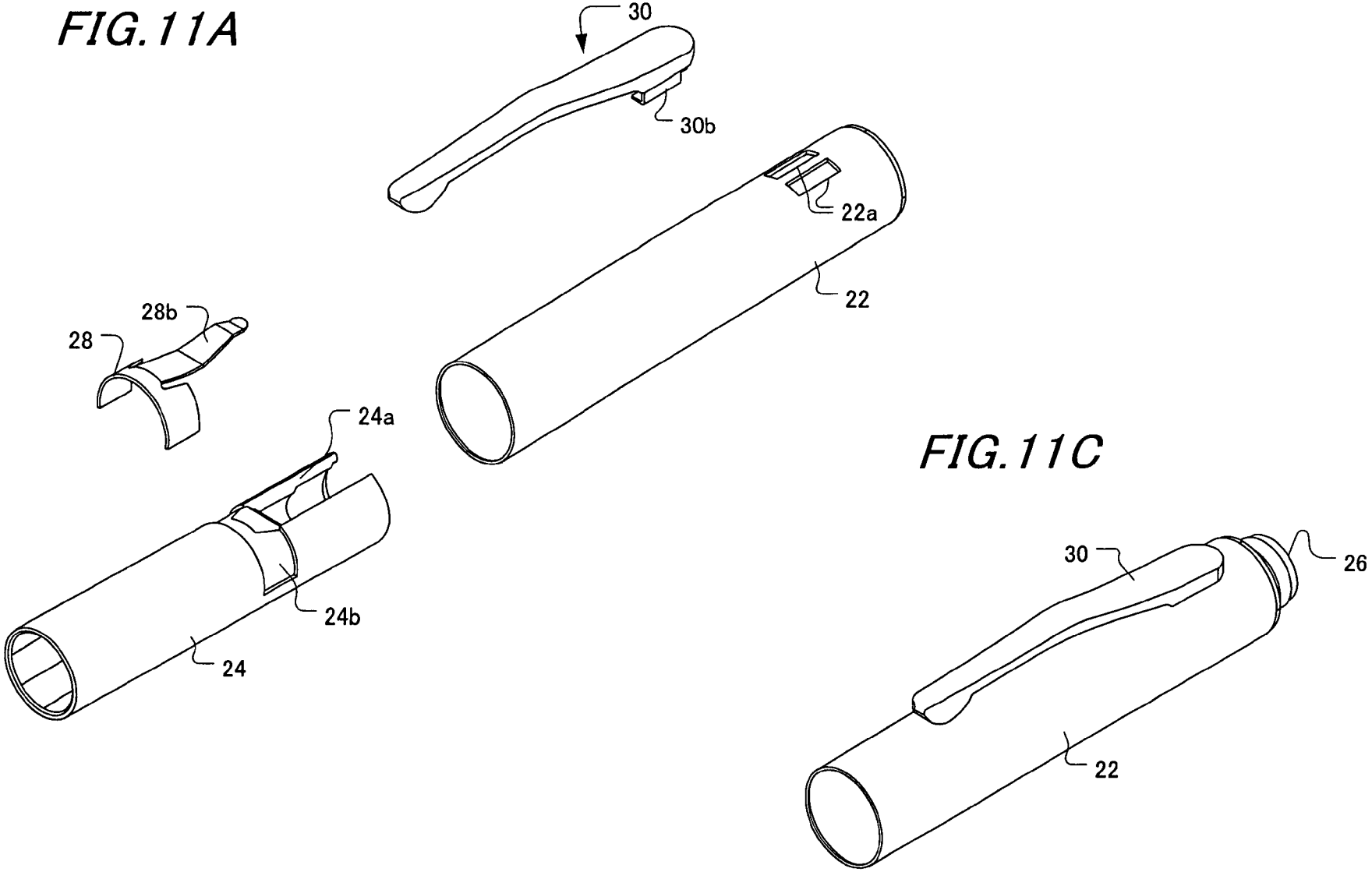
FIG. 11A is a view showing the assembly procedure of the clip fixing structure of the second embodiment.
FIG. 11C is a view showing the assembly procedure of the clip fixing structure of the second embodiment.

The outer shaft barrel 22 is formed on its periphery with a pair of slit openings 22*a* and 22*a* to be inserted by the base portions 30*b* of the clip 30 (see FIG. 11A).

Figure 9A:
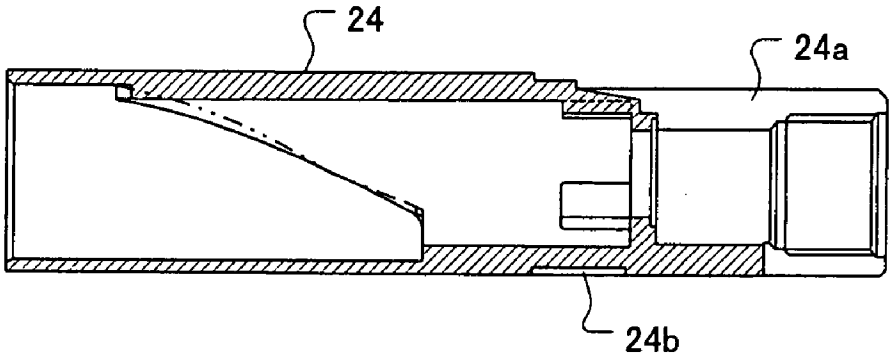
FIG. 9A is a longitudinal sectional view of the inner shaft barrel of the second embodiment.
Figure 9B:
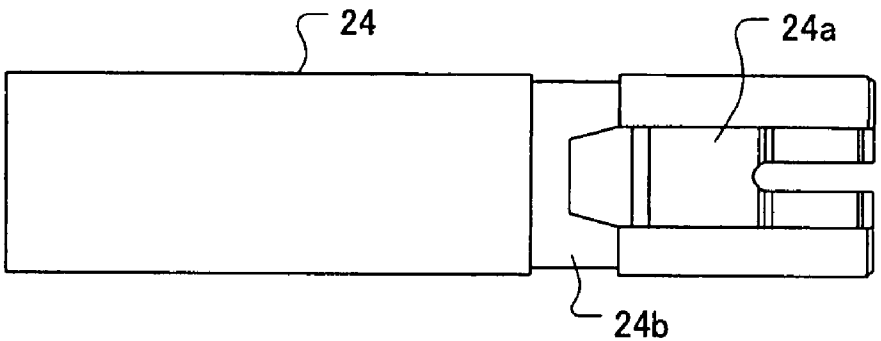
FIG. 9B is a plan view of the inner shaft barrel of the second embodiment.

The inner shaft barrel 24, as shown in FIGS. 9A and 9B, is formed on the periphery of the rear end portion with an opening 24*a* communicating rearward, and adjacent to the opening 24*a*, a circumferential groove 24*b* extending in a circumferential direction is formed. The circumferential groove 24*b*, similarly to the first embodiment, may be a circular groove extending in a full circle, but in this example, it is a circumferential groove extending approximately in a half-circle.

Figure 10A:
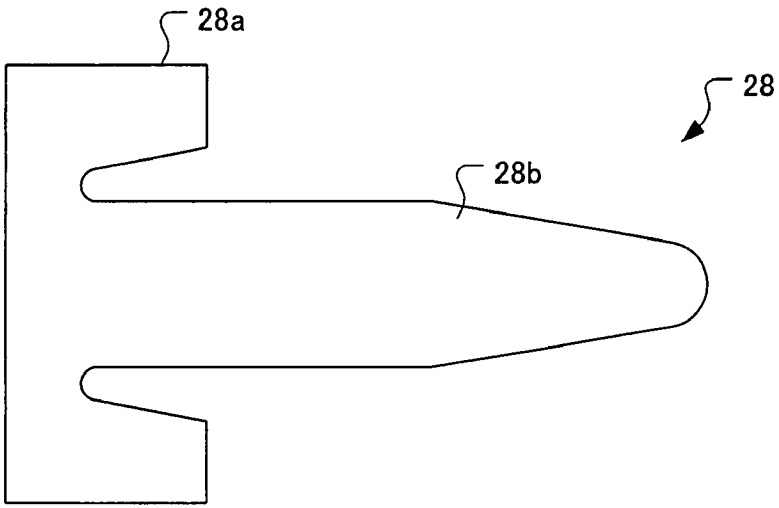
FIG. 10A is a plan view of the clip spring of the second embodiment.
Figure 10B:
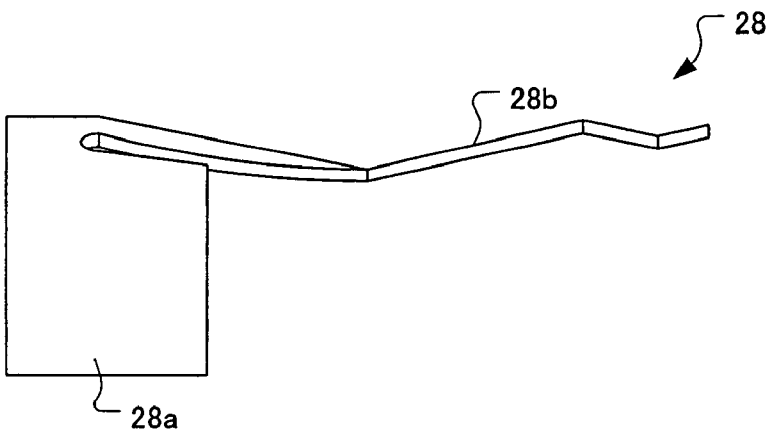
FIG. 10B is a side view of the clip spring of the second embodiment.

The circumferential groove 24*b* of this inner shaft barrel 24 is fitted and fixed with a clip spring 28. The clip spring 28, as shown in FIG. 10, has a half-ring portion 28*a* fitted to the circumferential groove 24*b* and an elastic piece portion 28*b* extending rearward from one portion of the half ring 28*a* by interposed between a pair of notches. Further, the elastic piece portion 28*b* is properly curved in a natural state, and its degree of curvature can be elastically changed.

The rear inside of the inner shaft barrel 24 is screwed with the tail tap 26. The tail tap 26 and the inner shaft barrel 24 are connected with each other crossing the rear end surface of the outer shaft barrel 22 so that they are attached to the outer shaft barrel 22.

The clip fixing procedure of the clip fixing structure configured by the above described component parts will be described with reference to FIGS. 11A to 11C.

First, the circumferential groove 24*b* of the inner shaft barrel 24 is fitted with the half ring portion 28*a* of the clip spring 28. At this time, since the half ring portion 28*a* is a half ring having approx. 180 degrees, it can be simply fitted.

Figure 11B:
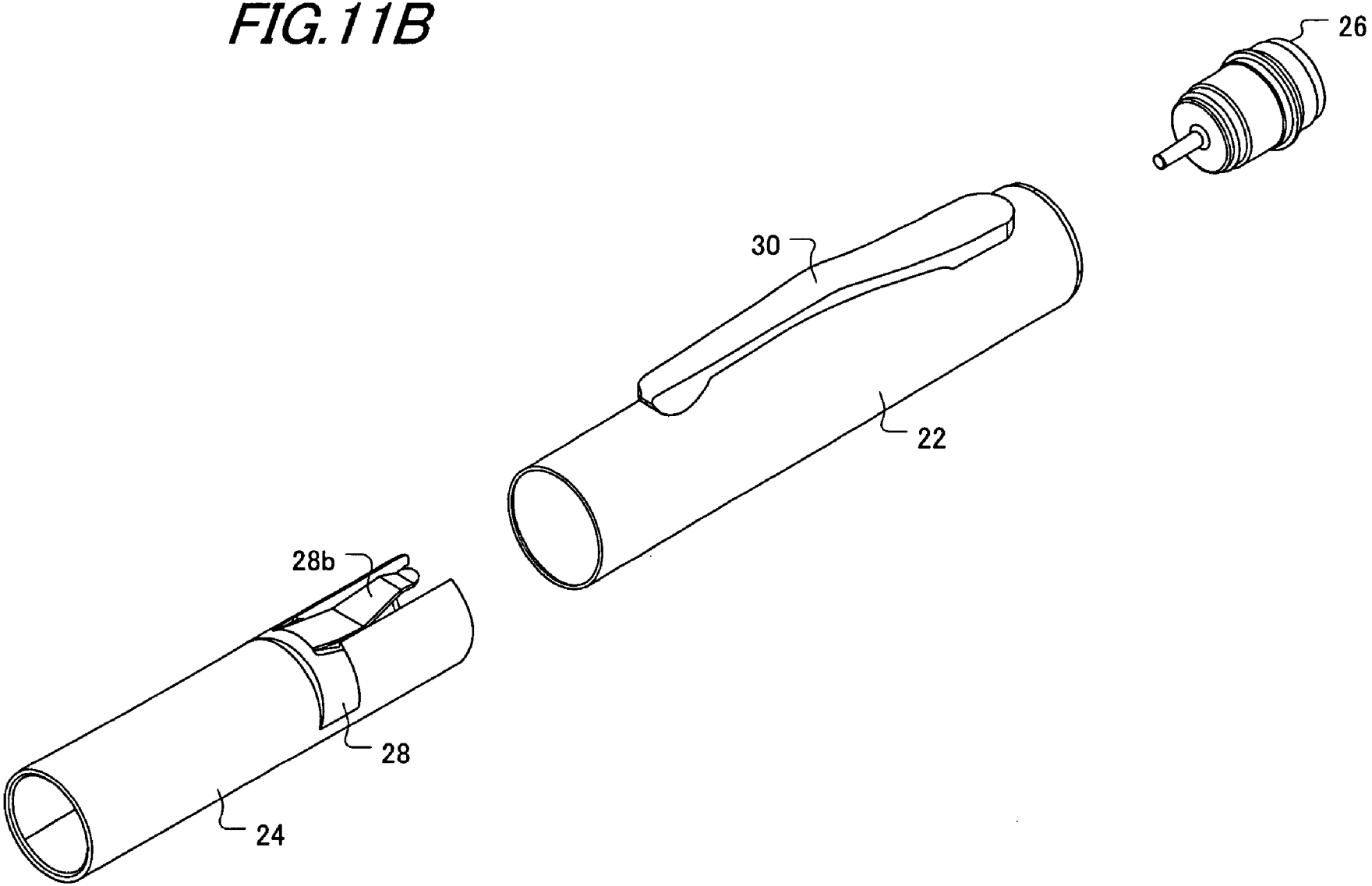
FIG. 11B is a view showing the assembly procedure of the clip fixing structure of the second embodiment.

In the meantime, each base portion 30*b* of the clip 30 is inserted into the corresponding slit openings 22*a* and 22*a* of the outer shaft barrel 22, and after that, the assembly of the inner shaft barrel 24 and clip spring 28 is inserted into the outer shaft barrel 22 from the front of the outer shaft barrel 22 (FIG. 11B). Further, the tall tap 26 is inserted from the rear of the outer shaft barrel 22, and is screwed to the inner shaft barrel 24.

Since a pair of base portions 30*b* of the clip 30 have bent portions 30*c* turning at almost right angles so as to close with each other, in the opening 24*a* of the inner shaft barrel 24 inside the fixed member 10, the base portion 30*b* of the clip 30 configures a loop portion together with the outer shaft barrel 22. Into this loop portion, the elastic piece portion 28*b* of the clip spring 28 is inserted.

In this manner, by simpler assembly procedure, the clip 30 can be fixed to the fixed member 10. Since in a fixed state of the clip 30, the elastic piece portion 28*b* of the clip spring 28 is inserted into the loop portion configured by the base portion 30*b*, the clip 30 is impossible to be removed from the fixed member 10. Note that, since the loop portion is to maintain a state, in which the elastic piece portion 28*b* is inserted, it has no need to be a fully closed loop as in this example. The loop portion configured by the base portion 30*b* of the clip 30 elastically contacts the elastic piece portion 28*b*.

Figure 7B:
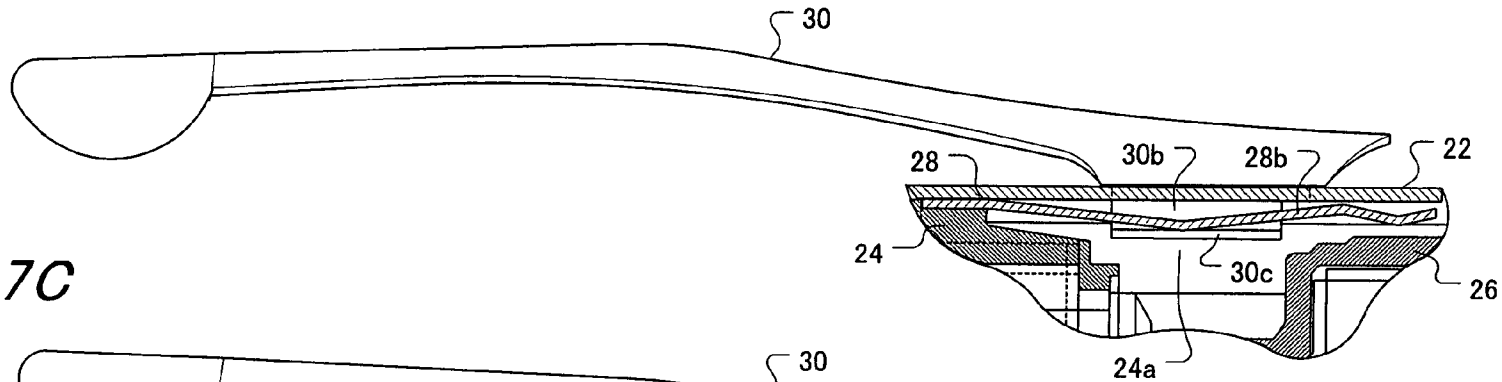
FIG. 7B Is a partially sectional enlarged view of FIG. 7A.
Figure 7C:
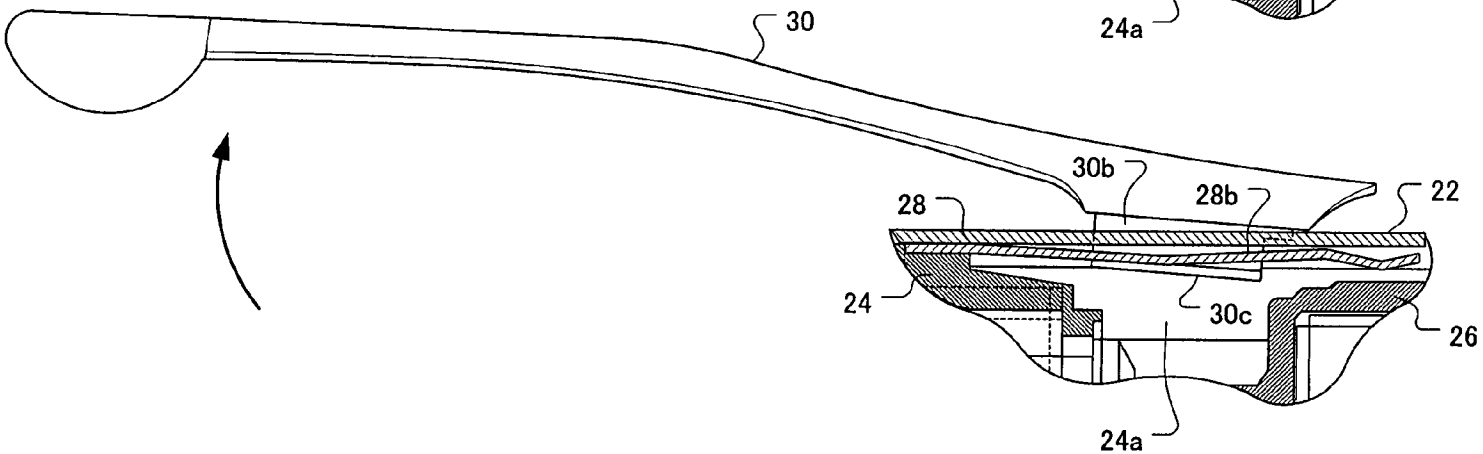
FIG. 7C is a partially sectional enlarged view of FIG. 7A, and shows a state in which the clip is rocked.

When the clip 30 fixed in this manner, as shown in FIG. 7B and 7C, is rocked so as to nip a thing between the clip 30 and the outer shaft barrel 22, the clip 30 rotates around the rear end portion of the base portion 30*b* as a fulcrum point, and at this time, since the bent portions 30*c* press the elastic piece portion 28*b* to push it toward outside of the outer shaft barrel 22, the elastic piece portion 28*b* is deformed. Further, when the force applied to the clip 30 is released, the elastic piece portion 28*b* is restored to its original state by the restoring force of the elastic piece portion 28*b*.

In this manner, by utilizing the spring force of the elastic piece portion 28*b* of the clip spring 28, the clip 30 can be rocked, and therefore, the elastic force of the clip 30 itself is not needed to use mainly, thereby providing an excellent operability.

Third Embodiment

Figure 12A:
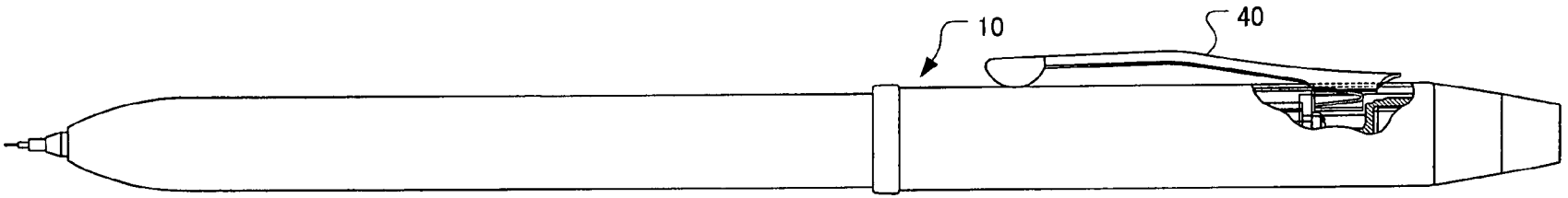
FIG. 12A is a whole view of a writing tool adapted to the clip structure according to a third embodiment of the present invention.

FIG. 12 is a whole view of a writing tool adapted to the clip structure according to a third embodiment of the present invention. The same component parts as the first embodiment are attached with the same reference numerals, and therefore, the description thereof will be omitted.

In the Figure, reference numeral 10 denotes a product, and the product 10, to be more in detail, comprises an outer shaft barrel 22 as a fixed member, an inner shaft barrel 24, a tail tap 26, and moreover, a functional unit including the inner shaft barrel 24 or configured separately from the inner shaft barrel 24.

Figure 13B:
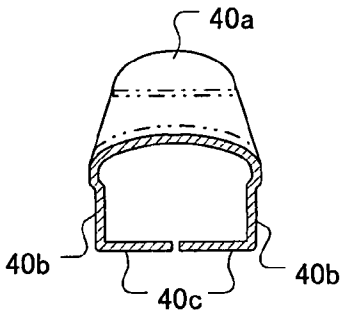
FIG. 13B is a sectional view taken along the line 13B to 13D of FIG. 13A.
Figure 13A:
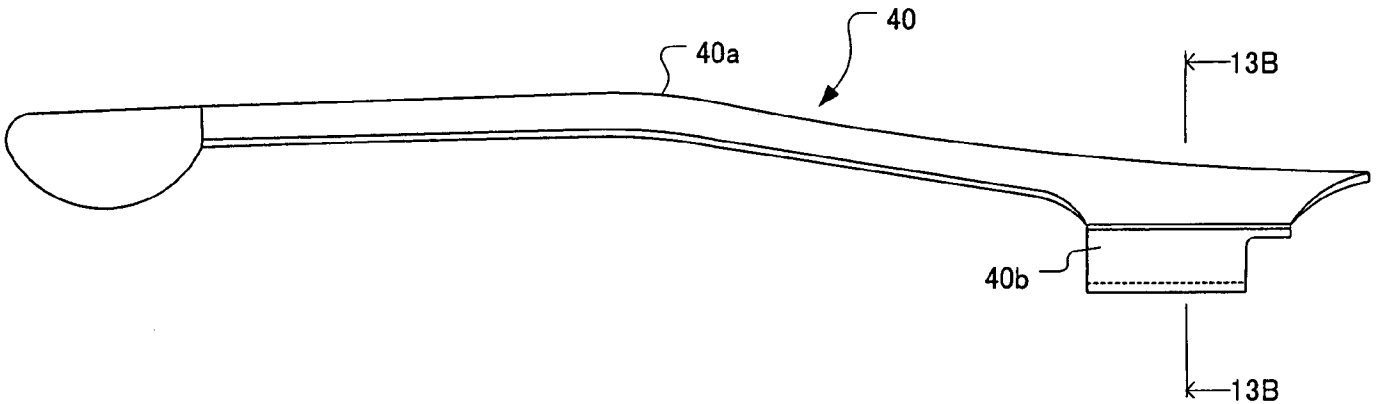
FIG. 13A is a side view of the clip of the third embodiment.

A clip 40 to be fixed to the outer shaft barrel 22, as shown in FIG. 13, comprises a clip main body 40*a* which extends along the outer periphery of the outer shaft barrel 22 and has a transverse sectional shape of an inverted U shape in its entirety and a pair of base portions 40*b* which enter into the outer shaft barrel 22. Between the tip end of the clip main body 40*a* and the outer shaft barrel 22, a document, clothing, and the like can be nipped. A pair of base portions 40*b* extend from the rear end of the clip main body portion 40*a* to the outer shaft barrel 22, and the tip end thereof has bent portions 40*c* turning at almost right angles so as to close with each other.

Figure 14A:
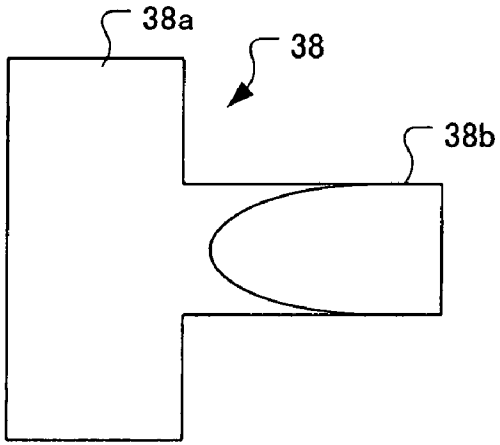
FIG. 14A is a plan view of the clip spring of the third embodiment.
Figure 14B:
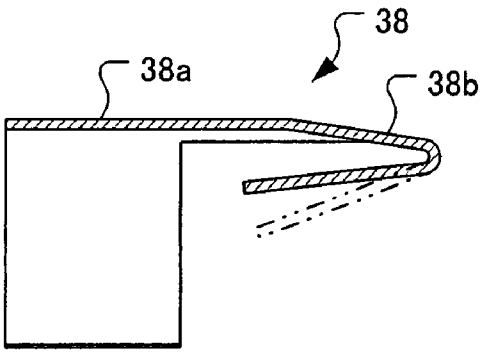
FIG. 14B is a longitudinal sectional view of the clip spring of the third embodiment.

The clip spring 38, as shown in FIG. 14A, has a half-ring portion 38*a* fitted to the circumferential groove 24*b* of the inner shaft barrel 24 and an elastic piece portion 38*b* extending rearward from one region of the half-ring 38*a*. Further, the elastic piece portion 38*b* has its tip end folded back, and the folded back tip end can be elastically changed in its bent angle.

The clip fixing procedure of the clip fixing structure configured by the above described component parts is almost the same as the second embodiment, and is performed by the procedures of FIGS. 11A to 11C. That is, the elastic piece portion 38*b* of the clip spring 38 is inserted into a space surrounded by the loop portion configured by the base portion 40*b* of the clip 40 and its bent portion 40*c*. Further, the loop portion configured by the base portion 40*b* of the clip 40 elastically contacts the elastic piece portion 38*b*.

In this manner, by simpler assembly procedure, the clip 40 can be fixed to the outer shaft barrel 22. Since in a fixed state of the clip 40, the elastic piece portion 38*b* of the clip spring 38 is inserted into the base portion 40*b*, the clip 40 is impossible to be removed from the outer shaft barrel 22.

Figure 12B:
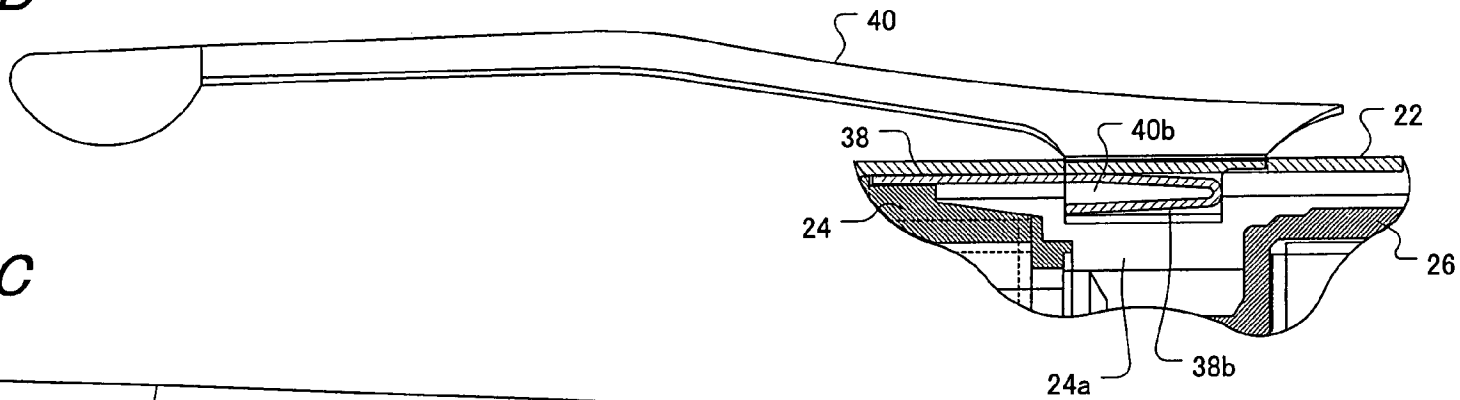
FIG. 12B is a partially sectional enlarged view of FIG. 12A.
Figure 12C:
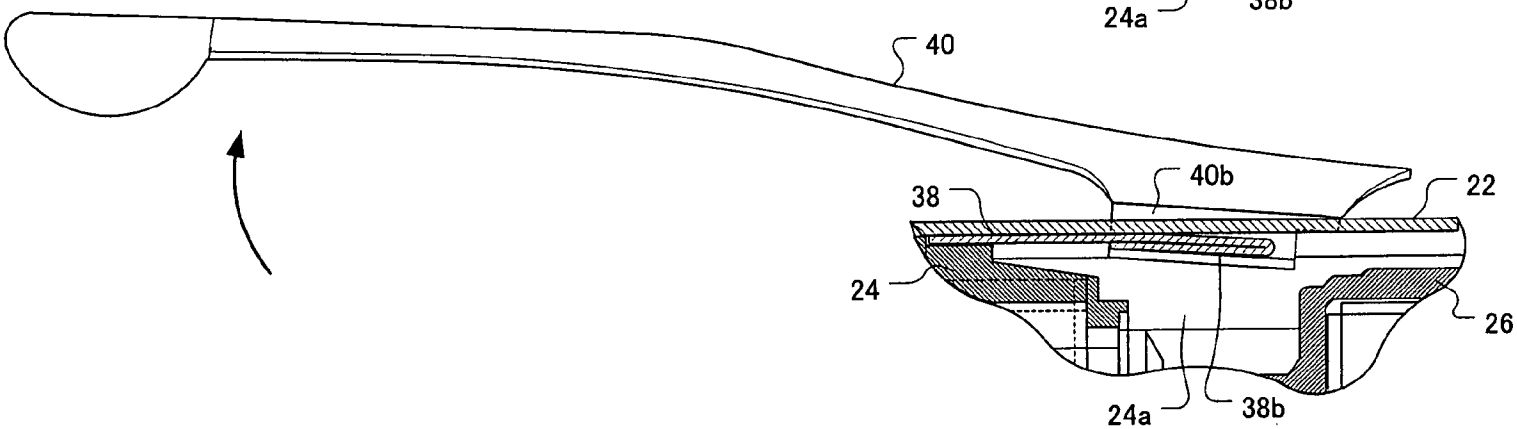
FIG. 12C is a partially sectional enlarged view of FIG. 12A, and shows a state in which the clip Is rocked.

When the clip 40 fixed in this manner, as shown in FIGS. 12B and 12C, is rocked so as to nip a thing between the clip 40 and the outer shaft barrel 22, the clip 40 rotates around the rear end portion of the base portion 40*b* as a fulcrum point, and at this time, since the bent portions 40*c* press the elastic piece portion 38*b* to push it toward outside of the outer shaft barrel 22, the elastic piece portion 38*b* is deformed. Further, when the force applied to the clip 40 is released, the elastic piece portion 38*b* is restored to its original state by the restoring force of the elastic piece portion 38*b*.

In this manner, by utilizing the spring force of the elastic piece portion 38*b* of the clip spring 38, the clip 40 can be rocked, and therefore, the elastic force of the clip 40 itself is not needed to use mainly, thereby providing an excellent operability. In this embodiment, since the elastic piece portion 38*b* is folded back, the elastic force becomes high, and high restoring force of the clip 40 can be obtained, and moreover, the durability of the clip spring 38 can be also increased.

While the principles of the invention have been described above in connection with specific embodiments, and particular modifications thereof, it Is to be clearly understood that this description is made only by way of example and not as a limitation on the scope of invention.

What is claimed is:

1. A clip fixing structure, comprising:

a fixed member having an outer peripheral surface formed with an opening in the outer peripheral surface;

a clip fixed to the fixed member;

a clip spring having an elastic piece portion which is elastically displaceable and fixedly disposed inside the fixed member; and an inner barrel inserted in and attached to the fixed member, wherein a portion of the clip spring is fitted to said inner barrel and said elastic piece portion extends from said portion of the clip spring, wherein the clip comprises a clip main body disposed outside of the fixed member and a base portion entering into the fixed member from the opening, wherein the base portion of said clip is prevented from falling out of the opening by the clip spring with elastically contacting the elastic piece portion of the clip spring inside said fixed member so that the clip is fixed to the fixed member, and wherein the clip is rockable relative to the fixed member by displacing the elastic piece portion of the clip spring.

2. The clip fixing structure according to claim 1, wherein the base portion of said clip is prevented from falling out by being restrained by the clip spring.

3. The clip fixing structure according to claim 2, wherein the base portion of said clip has an engaging portion to engage with one region of the clip spring, and a stopper portion to abut against an end surface portion of the elastic piece portion, and the base portion of the clip, at a fixing operation, enters into the fixed member while pressing the elastic piece portion, and when moving so as to engage with one region of the clip spring, the stopper portion abuts against the end surface portion of the elastic piece portion.

4. The clip fixing structure according to claim 2, wherein the base portion of said clip comprises a loop portion inside the fixed member, and is prevented from falling out by the elastic piece portion inserted into the loop portion.

5. The clip fixing structure according to claim 4, wherein the base portion of said clip comprises said loop portion together with a portion of the fixed member.

6. The clip fixing structure according to claim 4, wherein said elastic piece portion is folded back at a tip end, and the folded back portion is inserted into said loop portion.

7. The clip fixing structure according to claim 1, wherein the clip further has a notch formed on the base portion, the notch being engageable with the clip spring.

8. The clip fixing structure according to claim 7, wherein the clip further comprises a stopper step portion formed opposite the notch, the stopper step portion being engageable with a receiving portion of the clip spring.

9. The clip fixing structure according to claim 1, wherein the clip spring comprises a C-shaped ring portion having a single opening therein and the elastic piece portion extends from a surface of the C-shaped ring portion.

10. The clip fixing structure according to claim 9, wherein the clip spring further comprises at least one receiving portion extending from the elastic portion.

11. The clip fixing structure according to claim 10, wherein the inner barrel comprises an opening in a surface thereof and the elastic piece portion and the at least one receiving portion are disposed within the opening in the inner barrel.

12. The clip fixing structure according to claim 11, wherein the opening in the inner barrel is aligned with the opening in the outer peripheral surface of the fixed member.

13. The clip fixing structure according to claim 1, wherein the clip spring is fitted around an outer peripheral surface of the inner barrel.

14. A clip fixing structure, comprising:

a fixed member having an outer peripheral surface with an opening formed therein;

an inner barrel inserted in and attached to the fixed member;

a clip spring fitted to an outer peripheral surface of the inner barrel; and a clip comprising a clip main body disposed outside of the fixed member and a base portion disposed within the fixed member at the opening formed on the outer peripheral surface of the fixed member.

15. The clip fixing structure according to claim 14, wherein the clip spring comprises an elastic piece portion disposed inside the fixed member at the opening formed in the outer peripheral surface of the fixed member.

16. The clip fixing structure according to claim 14, wherein said clip spring comprises a C-shaped ring portion having a single opening therein and the elastic piece portion extends from a surface of the C-shaped ring portion.

17. The clip fixing structure according to claim 15, wherein the clip elastically contacts the elastic piece portion of the clip spring inside said fixed member and the clip is prevented from falling out of the opening in the outer peripheral surface by the clip spring so that the clip is fixed to the fixed member.

18. The clip fixing structure according to claim 15, wherein the clip is rockable relative to the fixed member by displacing the elastic piece portion of the clip spring.

19. The clip fixing structure according to claim 15, wherein the base portion of the clip passes through the opening formed in the outer peripheral surface of the fixed member and into an opening in the outer peripheral surface of the inner barrel.

20. The clip fixing structure according to claim 19, wherein the clip is elastically fixed to the clip spring.

* * * * *